United States Patent [19]

Harned et al.

[11] 4,372,476

[45] Feb. 8, 1983

[54] SELF-LOCKING TRAY WITH INTEGRAL DIVIDER

[75] Inventors: Frederich C. Harned, Martinez; Scott M. Galloway, Augusta, both of Ga.

[73] Assignee: The Continental Group, Inc., Stamford, Conn.

[21] Appl. No.: 185,476

[22] Filed: Sep. 9, 1980

[51] Int. Cl.[3] ..... B65D 5/08

[52] U.S. Cl. ..... 229/16 A; 229/16 R; 229/27; 229/34 R

[58] Field of Search ..... 229/16 R, 16 A, 16 C, 229/16 D, 23 A, 27, 6 A, 29 B, 34 R, 34 B, 41 B, DIG. 11; 206/183

[56] References Cited

U.S. PATENT DOCUMENTS

| | | | |
|---|---|---|---|
| 1,946,795 | 2/1934 | Jonas | 229/16 A |
| 2,698,125 | 12/1954 | Vizcarrondo et al. | 229/27 |
| 2,838,221 | 6/1958 | Wilson | 229/27 |
| 2,910,220 | 10/1959 | Hamilton | 229/15 |
| 2,913,162 | 11/1959 | Goltz | 229/16 A |
| 2,942,768 | 6/1960 | McCall | 229/16 A |
| 2,957,615 | 10/1960 | Karr et al. | 229/16 A |
| 2,989,223 | 6/1961 | Magazzu | 229/16 A |
| 3,002,672 | 10/1961 | Kotowick | 229/16 R |
| 3,012,703 | 12/1961 | Gander | 229/16 A |
| 3,014,633 | 12/1961 | Tarmina | 229/16 A |
| 3,055,569 | 9/1962 | Layne, Sr. | 229/16 A |
| 3,055,570 | 9/1962 | Hamilton | 229/16 A |
| 3,102,674 | 9/1963 | Hamilton | 229/15 |
| 3,194,972 | 7/1965 | Crane | 229/27 |
| 3,203,613 | 8/1965 | Stowe | 229/16 R |
| 3,843,040 | 10/1974 | Locke | 229/16 R |

FOREIGN PATENT DOCUMENTS

| | | | |
|---|---|---|---|
| 716435 | 8/1965 | Canada | 229/DIG. 11 |
| 1066597 | 1/1954 | France | 229/16 R |
| 1290263 | 3/1962 | France | 229/16 A |
| 921184 | 3/1963 | United Kingdom | 229/DIG. 11 |

*Primary Examiner*—William Price
*Assistant Examiner*—Gary E. Elkins
*Attorney, Agent, or Firm*—Charles E. Brown

[57] ABSTRACT

A tray for the packaging and shipping of fruits and vegetables, such as strawberries. The tray is formed from a generally rectangular blank which may be hand assembled in the field. The interlocking of the various components of the tray assure a rigid construction. The tray includes central supports in the form of separators or partitions, which central supports have upper edges coplanar with the top surfaces of the ends of the trays so as to support the central portion of the next upper tray. The ends of tray are constructed to provide relatively wide upstanding supports which have extending upwardly therefrom locking flaps engageable within openings in the bottom of a next upper tray. The tray also has a double bottom for added strength.

5 Claims, 7 Drawing Figures

80
82
86
52
84
30
40
16
88
4
48
74
72
60
26
44
62
70
5
3
22
34
20

SELF-LOCKING TRAY WITH INTEGRAL DIVIDER

This invention relates in general to new and useful improvements in tray construction, and more particularly to a tray of the type designed for receiving boxes of fruits and vegetables.

Trays of the type to which this invention relate are stacked one on the other with the bottom trays in the stack supporting the weight of the other trays. Accordingly, stack stability is required. Unless there is stack stability, possible product damage can result particularly if the trays fall or if one end of one tray moves slightly and falls into the cavity of the tray below it.

In view of the foregoing, it is highly desirable to provide a tray which is sufficiently rigid so as to prevent the bottom of the trays from sagging when they are stacked on top of each other and at the same time to maintain the ends of the trays in vertical alignment.

Another requirement of the trays is that they can be set up by hand in the packing fields. The two most popular designs currently in use must be set up by a machine in a central packing house and then transported to the various field packing locations. The fact that these trays must be transported in a set-up space means that they do not utilize trailer space as efficiently as the invention. The trays of this invention occupy roughly one-eighth as much space as the existing trays.

Further, in accordance with this invention, the tray has a central divider to prevent the bottom of next upper trays from sagging when they are stacked on top of each other. While this feature is present in existing trays which are set-up by machine, it is not known to the inventors in trays which are hand set-up.

Each end panel of the tray is provided with an upstanding tab which locks into a cut out area in the bottom of the tray immediately above. These tabs serve to keep a stack of trays in perfect vertical alignment and to maintain stability of the stack. Proper alignment ensures that the bottom trays in the stack support the weight of the other trays.

The trays are also readily adaptable to the use of an existing wire stacking aid.

The blank from which the tray is formed is also believed to be novel particularly in the inner connection of the various panels.

With the above and other objects in view that will hereinafter appear, the nature of the invention will be more clearly understood by reference to the following detailed description, the appended claims, and the several views illustrated in the accompanying drawings.

IN THE DRAWINGS

Figure 6:
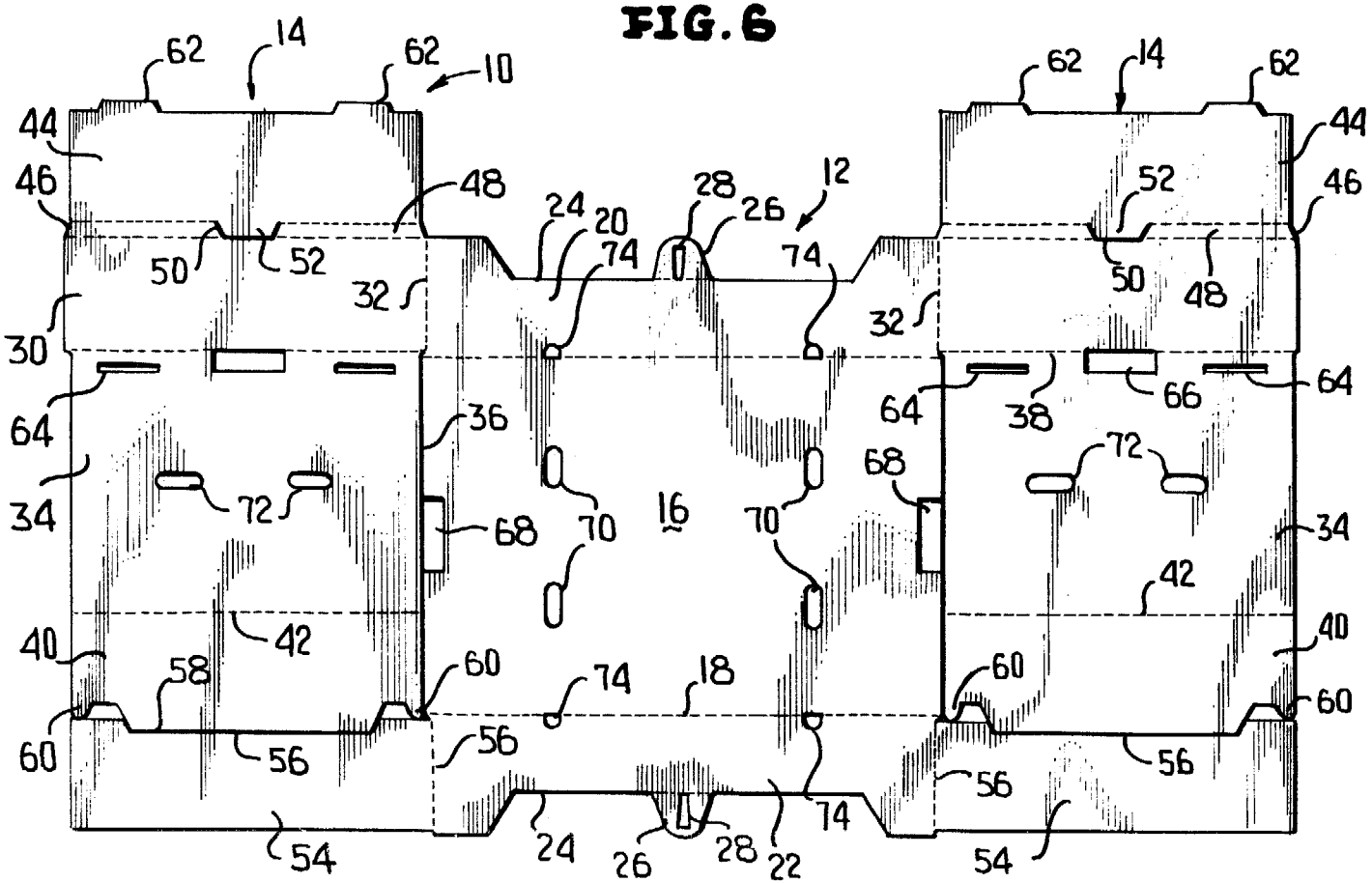
FIG. 6 is a plan view on a reduced scale of the blank from which the tray is formed.

Referring now to the drawings in detail, reference is first made to FIG. 6 wherein the configuration of the blank from which the tray of this invention is formed, as shown. The blank is generally identified by the numeral 10 and is formed from a flat sheet of material, preferably corrugated board, but not so limited. The blank 10 is generally rectangular in outline and includes a central portion 12 and like end portions 14.

The central portion 12 includes a centrally located bottom panel 16 which has hingedly connected thereto along one side by way of a hinge line 18 a side panel 20. A similar side panel 22 is hingedly connected to the opposite side of the base panel 16. The side panels 20, 22 are of like configuration and each has a notched top edge 24 from which there projects a centrally located latching flap 26. Each latching flap 26 is provided with a central opening 28, the purpose of which will be described in detail hereinafter.

Each end portion 14 includes an outer end panel 30 which is hingedly connected to an adjacent end of the side panel 20 along a hinge line 32. Each outer end panel 30 carries a bottom panel 34 which is disposed along side, but is separated from an end of the base panel 16 by a cut line 36. Each bottom panel 34 is hingedly connected to its respective outer end panel 30 along a hinge line 38.

Each bottom panel 34 comprises a partition panel 40 which is hingedly connected thereto along a hinge line 42. The partition panel 40 is also disposed adjacent an end of the base panel 16 and is separated therefrom by the cut line 36.

Each outer end panel 30 also carries an inner end panel 44. The end panels 30 and 44 are hingedly connected together and spaced from each other by a double hinge or fold line arrangement 46 defining a narrow support panel 48. The central portion of this support panel 48 is interrupted by a U-shaped cut line 50 which defines a locking flap 52.

Each portion 14 of the blank 10 also includes an intermediate end panel 54 which is hingedly connected to a respective end of the side panel 22 by a hinge or fold line 56. The intermediate end panel 54 lies immediately adjacent the partition panel 40 and is separated therefrom by a cut line 56. The configuration of the cut line 56 is such as to define on the partition panel 40 a full height supporting edge 58 which extends a measure portion of the length of the partition panel 40, and upstanding locking ears 60 at the opposite ends of the partition panel 40 for cooperation with the locking tabs 26.

The edge of the each inner end panel 44 remote from the outer end panel 30 is provided with a pair of projecting locking flaps 62 and each bottom panel 34 is provided with a pair of slots 64 aligned with the locking flaps 62.

Each bottom panel 34 is also provided with a cut out 66 along the fold line 38 and aligned with the locking flap 52 for a purpose to be described hereinafter.

The base panel 16 is provided at the tops of the ends with cut out 68 which will be aligned with the cut out 66 in the finished tray, as described hereinafter. The base panel 16 is also provided with suitable vent openings 70 and like vent openings 72 are formed in the bottom panels 34 for alignment with the openings 70. If desired, the side panels 20, 22 may also be provided with vent openings 74.

Reference is now made to FIGS. 1 through 4 wherein the details of a tray formed from the blank 10 are illustrated, the tray being generally identified by the numeral 80. It will be seen that in the construction of the tray, the side panels 20, 22 are folded to upright positions relative to the base panel 16, and the outer end panels 30 are disposed in upstanding positions and at right angles to the side panels 20, 22. Each intermediate panel 54 is positioned between the respective outer end panel 30 and inner end panel 44 and the inner end panel 44 has its locking flaps 62 locked within the cut out 64 formed in the respective bottom panel 34 which has been folded to a position overlying the base panel 16.

Figure 5:
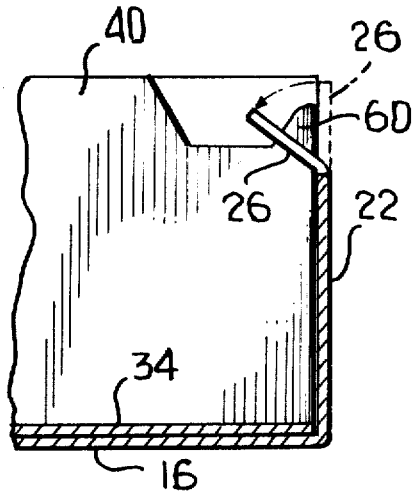
FIG. 5 is an enlarged fragmentary transverse vertical sectional view taken generally along the line 5—5 of FIG. 1 and shows the manner in which the partition panels are locked together and to the side panels.

The separator panels 40 have also been folded to upstanding positions and are in back-to-back relation. With reference to FIG. 5 in particular, it will be seen that the separator panels 40 are locked relative to the side panels by way of the tabs 28 which are engaged over the ears 60.

Figure 7:
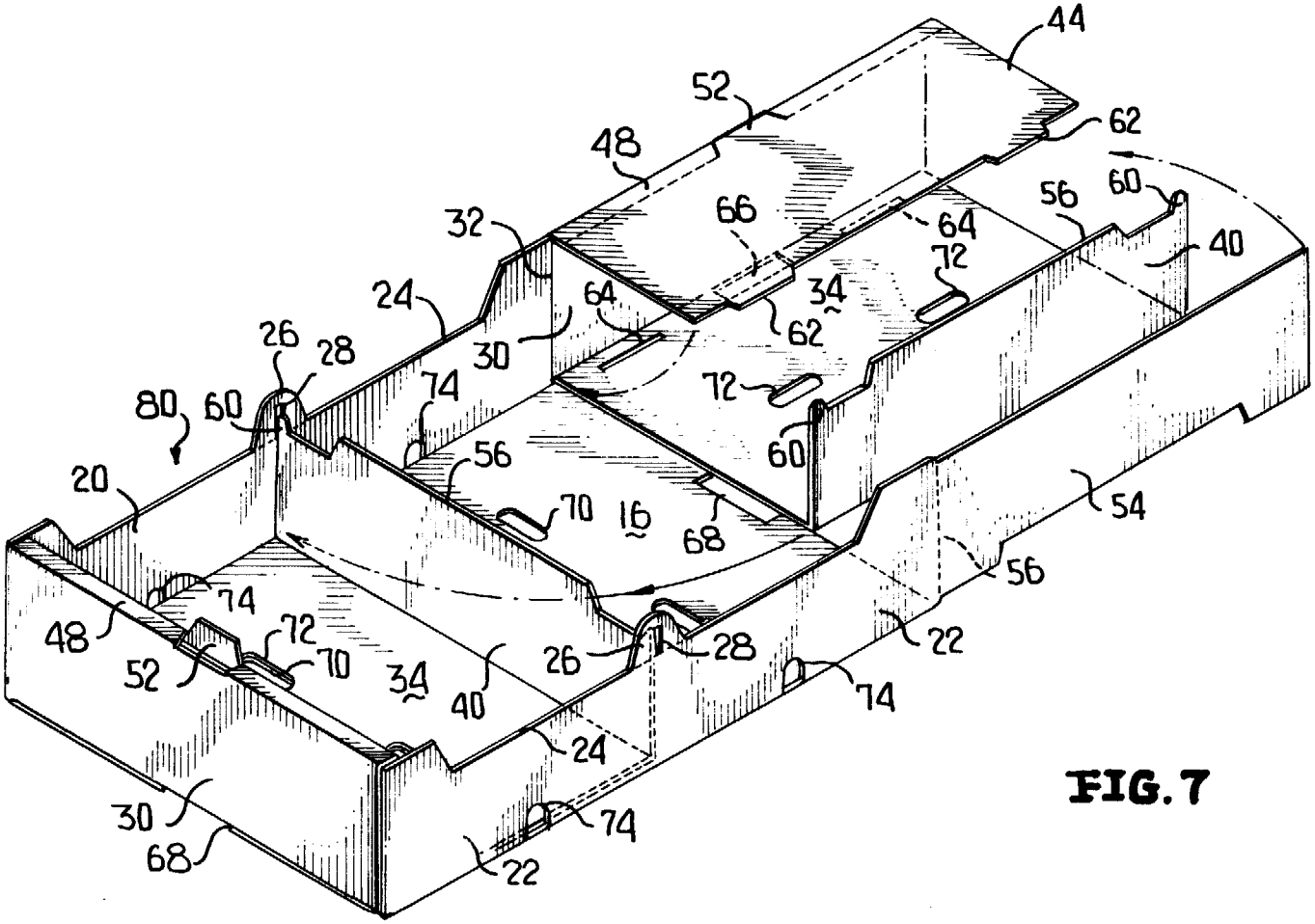
FIG. 7 is a perspective view similar to FIG. 1 but wherein the right half of the tray is only partially assembled from the blank.

It is to be understood that the tray 80 may be assembled in the field and with reference to FIG. 7, which shows the tray partially assembled and partially in intermediate stage of being assembled, the bottom panel 34 is folded relative to the outer end panels 30. At the same time the partition or separator panel 40 is folded up with respect to the bottom panel 34. The outer end panel 30 is then folded relative to the side panel 20. At the same time the intermediate end panel 54 is being folded inwardly relative to the side panel 22. After the bottom panel is in place overlying the base panels 16 and the intermediate end panels 54 it is disposed adjacent the outer end panel 30, the inner end panel 44 is folded down over the intermediate end panel 54 and locked in place relative to the bottom panel 34. The separator panels 40 are then latched in place relative to the side panels 20, 22.

Figures 1, 2:
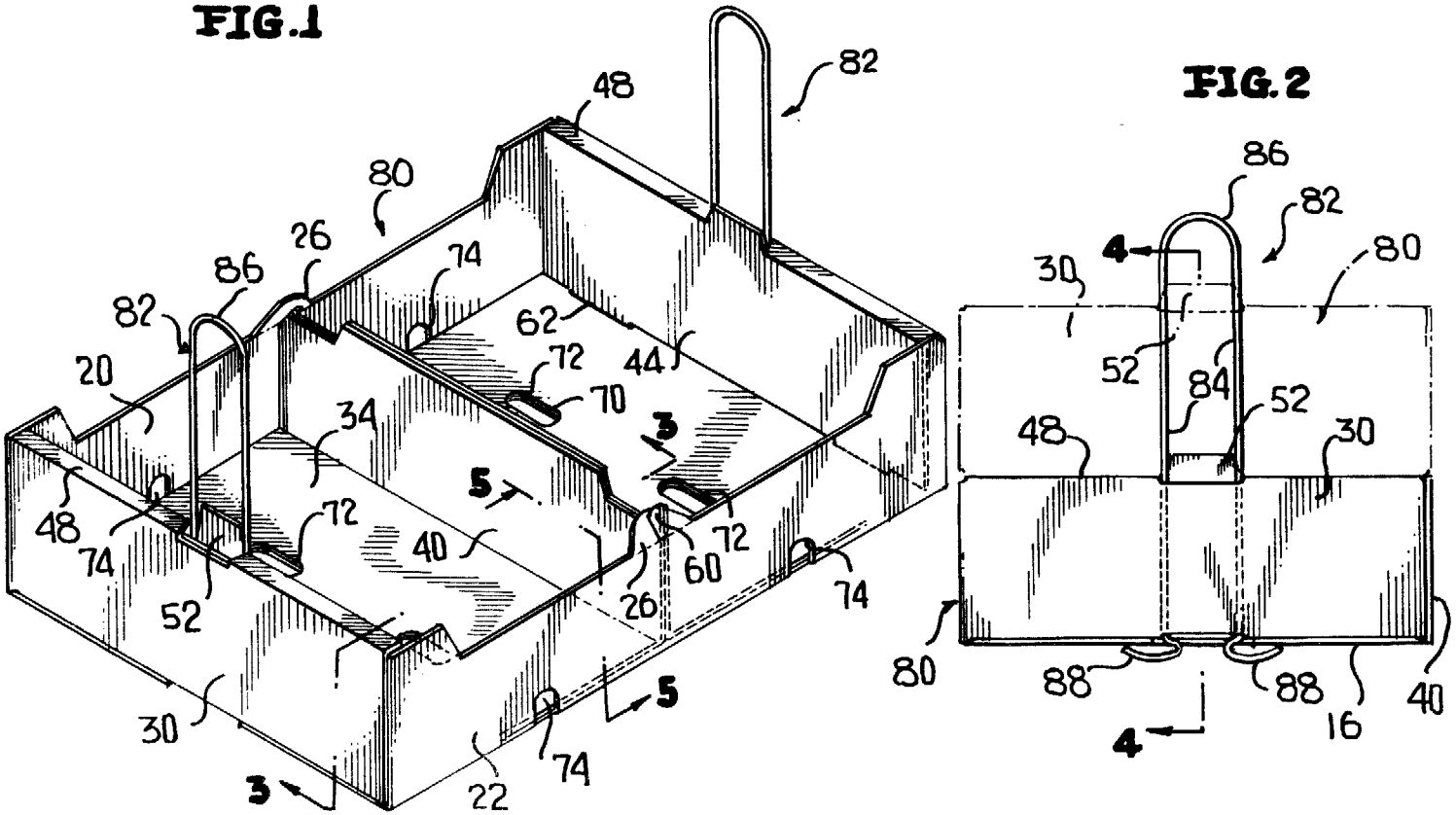
FIG. 1 is a top perspective view of one of the trays equipped with wire stacking aids.
FIG. 2 is an enlarged end elevational view of the tray of FIG. 1 with another tray stacked thereon and shown in dotted lines.
Figure 3:
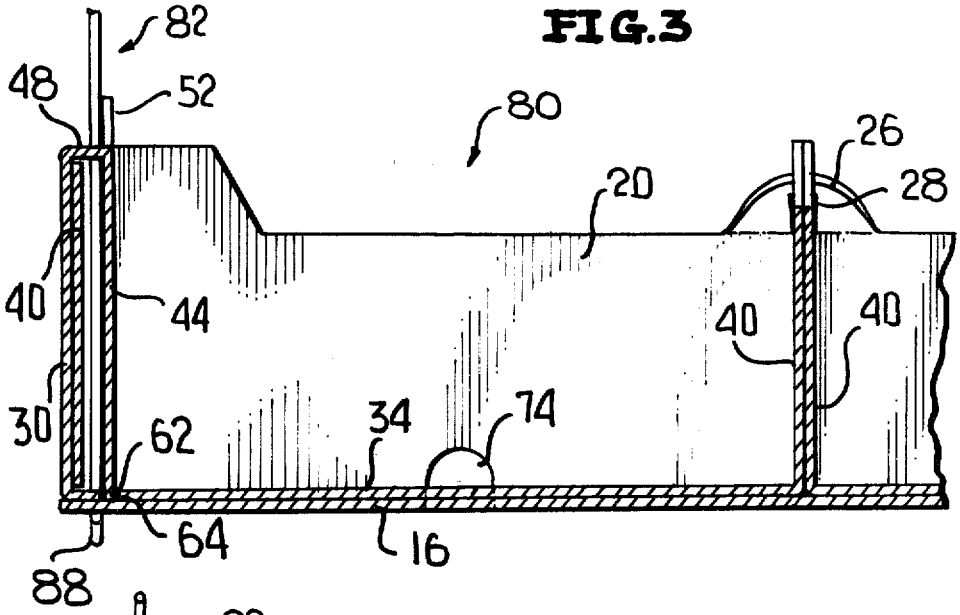
FIG. 3 is an enlarged fragmentary vertical view taken generally along the lines 3—3 of FIG. 1 and shows specifically the end and center partition construction of the tray.

With particular reference to FIGS. 1 and 3, it will be seen that in the folding of the inner end panels 40 relative to the outer end panels 30, the fold arrangement 46 results in the defining of an uppermost horizontal support 48 for a next upper tray. Further, the locking flap 52 becomes an extension of the associated inner end panel 44 and projects upwardly for reception into the underside of the next upper tray.

Figure 4:
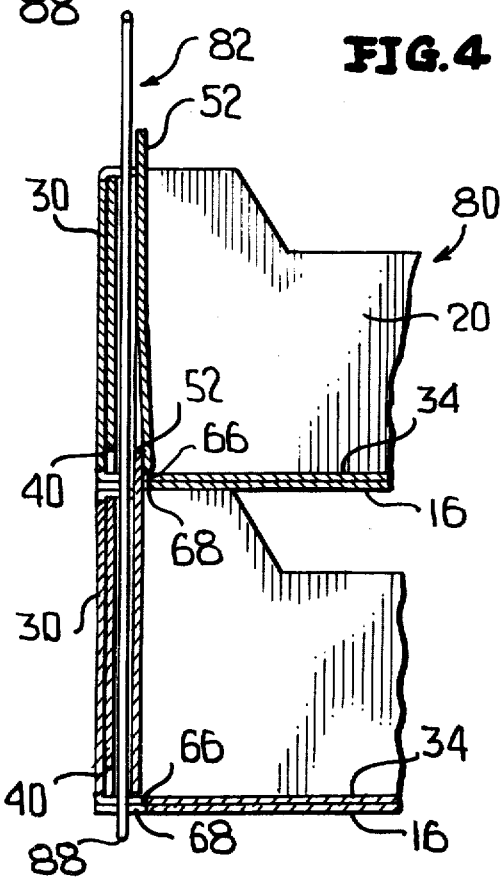
FIG. 4 is a fragmentary vertical sectional view taken generally along the line 4—4 of FIG. 2 and shows the specifics of the interlock between ends of vertically stacked trays.

As is clearly shown in FIG. 4, the notch 66 initially underlies an intermediate portion of the inner end panel 44. However, when the trays are stacked, the locking flaps 52 will enter first through the cut out or notch 68 in the base panel 16 and then into and through the notch 66 in the bottom panel 34 and into the interior of the end of the tray. This maintains the vertically stacked trays in alignment.

It is also to be understood that, as is best shown in FIG. 3, the upper edges of the partition panels 40 are coplanar with the support 48 so that the partition panels 40 provide adequate support for the central portion of the bottom of the next upper tray. In this way there can be no sagging of the bottom and there can be no misalignment of the vertically stacked trays which would cause the stack to tilt with the resultant loss of the packed fruit or vegetable.

It is also to be noted that the construction of the tray 80 is such that a grower may use in conjunction therewith, if the grower so desires, a conventional wire stacking aid generally identified by the numeral 82 and best illustrated in FIG. 2. The wire stacking aid 82 includes two elongated legs 84 which are joined at their upper ends by a bight 86. The lower ends of the legs are bent to define hooks 88 which engage beneath the base panels 16 and generally interlock with the base panel 16 and the botom panels 34.

It is to be noted that the stacking aid 82 may be used in cooperation with the locking flaps 52 without interference. It is also to be noted that the height of the stacking aid 82 is such that an upper portion thereof projects through a next upper tray 80 so that it may be utilized, one at each end of the tray, to carry two trays, and at the same time to permit the stacking of two more trays on top of those two trays with this stacking continuing as high as is desired or feasible.

It is to be understood that the stacking aid 82 is not a part of the invention per se.

From the foregoing, it will be readily apparent that the tray 80 has numerous advantages over prior art trays. Most particularly, the tray may be assembled in the field while at the same time having intermediate separator panels. Further, it has a double bottom arrangement which will prevent sagging of the bottom and thus shifting of stacked trays. Accordingly, the trays may be stacked to conventional heights without danger of displacement of the trays and damage to the packed fruit or vegetables.

Although only a preferred embodiment of the tray has been specifically illustrated and described herein, it is to be understood that minor variations may be made in the tray construction without departing from the spirit and scope of the invention as defined by the appended claims.

We claim:

1. A blank for a tray, said blank comprising a central portion and end portions which are alike, said central portion including a base panel said having side panels along two opposite edges thereof, and said end portions each being free of said base panel and having parts joined to each of said side panels, each end portion including a bottom panel and a partition panel both directly alongside and coextensive with an end of said base panel.

2. A blank for a tray, said blank comprising a central portion and end portions which are alike, said central portion including a base panel having side panels along two opposite edges thereof, and said end portions each being free of said base panel and having parts directly joined to each of said side panels, each end portion including an outer end panel directly hingedly connected to a respective end of one of said side panels and a bottom panel hingedly connected to said outer end panel and lying directly alongside and coextensive with said base panel, a partition panel directly hingedly connected to said bottom panel remote from said outer end panel, said partition panel also lying alongside said base panel and coextensive with said base panel.

3. A blank for a tray, said blank comprising a central portion and end portions which are alike, said central portion including a base panel having side panels along two opposite edges thereof, and said end portions each being free of said base panel and having parts joined to each of said side panels, each end portion including an outer end panel hingedly connected to a respective end of one of said side panels and an inner end panel hingedly connected to a respective outer end panel, an intermediate end panel hingedly connected to a respective end of the other of said side panels, a bottom panel and a partition panel carried by said outer end panel and disposed between said outer panel and said intermediate end panel.

4. A blank according to claim 3 wherein each of said partition panels is positioned directly alongside a respective one of said intermediate end panels and a portion of each of said partition panels is separated from the respective intermediate panel by a single line cut.

5. A tray comprising a base panel having side panels extending separately from opposite sides of said base panel, end panels extending upwardly at opposite ends of said base panel, and bottom panels extending inwardly from said end panels in overlying relation to said base panel, adjacent ends of said bottom panels carrying upstanding partition panels, cooperative locking means on said side panels and said partition panels, said locking means including a flap extension on each of said side panels overlying said partition panels and having a notch therein receiving upstanding ears at upper corners of said partition panels.

* * * * *